United States Patent [19]

Scott

[11] 4,354,402

[45] Oct. 19, 1982

[54] VOLUMETRIC APPARATUS WITH IMPROVED DRIVE SYSTEM

[76] Inventor: John W. Scott, 1510 Johanna, Houston, Tex. 77055

[21] Appl. No.: 75,427

[22] Filed: Sep. 14, 1979

[51] Int. Cl.[3] ..... B23Q 17/00; F16H 27/02

[52] U.S. Cl. ..... 74/822; 74/128; 74/141; 74/813 C

[58] Field of Search ..... 74/813 R, 813 C, 813 L, 74/821, 822, 817, 128, 88, 141

[56] References Cited

U.S. PATENT DOCUMENTS

| | | | |
|---|---|---|---|
| 1,942,927 | 1/1934 | Johnson et al. | 74/821 |
| 2,475,342 | 7/1949 | Vines | 74/822 |
| 2,968,973 | 1/1961 | Mead | 74/822 |
| 3,412,620 | 11/1968 | Bloom et al. | 74/141 |

*Primary Examiner*—Kenneth Dorner
*Attorney, Agent, or Firm*—Browning, Bushman, Zamecki & Anderson

[57] ABSTRACT

The invention pertains to rotary volumetric apparatus comprising a stationary framework and a rotary assembly mounted thereon. The rotary assembly includes a rotary shaft. The apparatus further includes a reciprocating drive engine and a driven member connected to the rotary shaft. A linkage system drivingly connects the driven member to the engine for rotation in a first direction upon reciprocating movement of the engine in a first directional mode and for rotation in a second direction opposite the first direction upon reciprocating movement of the engine in a second directional mode opposite the first mode. A clutch interconnects the driven member and the shaft and is operative upon rotation of the driven member in the first direction to cause rotation of the shaft therewith, and upon rotation of the driven member in the second direction, to permit relative rotation between the driven member and the shaft, whereby the shaft is rotated by the drive engine in temporally spaced increments.

10 Claims, 6 Drawing Figures

FIG. 1
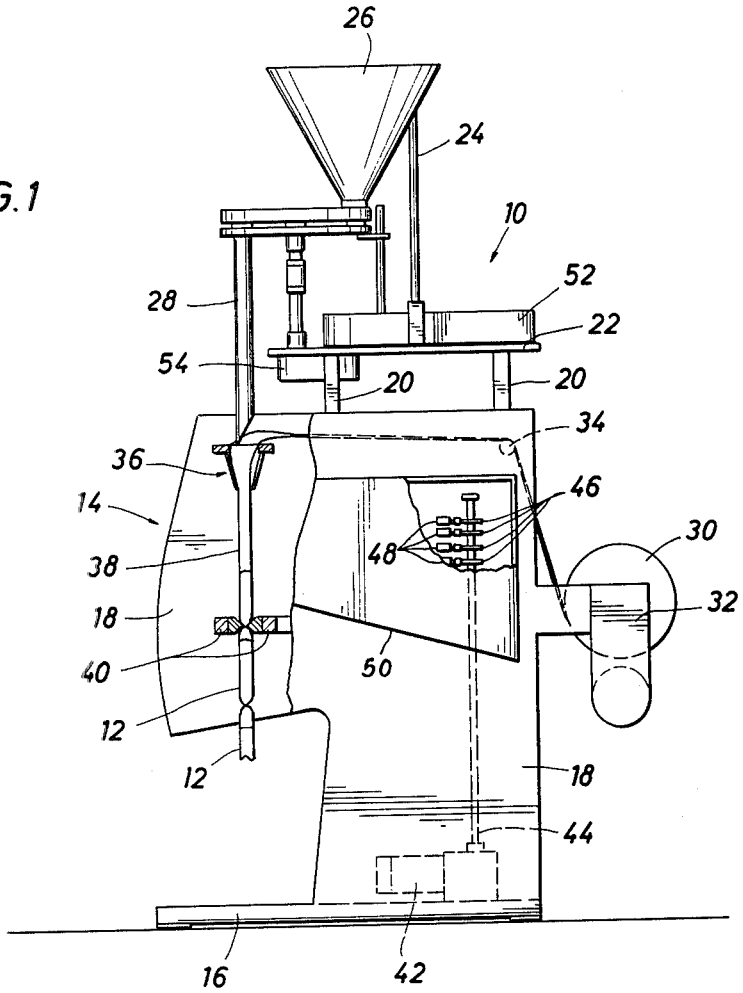
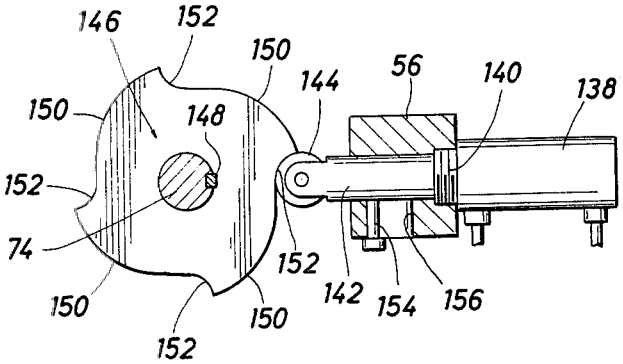
FIG. 4

VOLUMETRIC APPARATUS WITH IMPROVED DRIVE SYSTEM

BACKGROUND OF THE INVENTION

1. Field of the Invention

The invention pertains to volumetric apparatus of the type which is generally incorporated into an overall system for packaging small solid goods, typically food items such as peanuts, candies, beans, etc. Such a volumetric apparatus typically includes a stationary framework having a rotary assembly mounted thereon. The rotary assembly may include a shaft and a pair of spaced apart disc-like plates mounted on the shaft for joint rotation therewith. A number of containers or cups are provided between these two rotary plates and spaced circumferentially from one another. As the rotary assembly rotates, each cup passes a filling station where it is filled and thereby measures a pre-determined volume of the goods being packaged. The cup subsequently moves to a discharge station where said volume of goods is deposited in an individual package formed or being formed by another portion of the overall apparatus. In order to permit complete and proper filling and discharge of these cups at the respective stations therefor, the rotary assembly is preferably rotated in temporally spaced increments, rather than continuously.

2. Description of the Prior Art

One of the problems which has been encountered in such volumetric apparatus in the past is that of providing a satisfactory system for rotatably driving the rotary assembly of the volumetric apparatus in temporally spaced or discrete increments as described above. One of the most common techniques presently known is to use a common power source or engine for the rotary portion of the volumetric apparatus and for the other portions of the packaging apparatus in general. More specifically, this common power source has been connected to the rotary assembly of the volumetric apparatus by a geneva drive system. With such an arrangement, because the common power source was operating virtually all parts of the overall packaging apparatus, it was typically an engine having a relatively high power output. Then, if some of the goods being handled, e.g. sticky candies, became jammed at the discharge station thus preventing proper rotation of the rotary assembly of the volumetric apparatus, the drive system, in attempting to continue such rotation, would cause severe damage to the apparatus, typically the gears. Furthermore, even if no damage to the apparatus resulted from such a jam, prior devices have presented difficulties in returning the apparatus to proper synchronization after clearing of the jam.

Primitive attempts to alleviate these jamming problems in conventional devices have resulted in even more serious consequences. For example, in one instance an operator was known to attempt to prevent jamming by manually pushing the contents from the cups of the volumetric at the discharge station. This resulted in accidental loss of a finger. Subsequently, the same operator began using a small tool such as a screwdriver for the same purpose. The tool itself then became jammed in the apparatus causing even worse damage thereto than had previously been typical in cases where only the food products themselves had jammed the device.

SUMMARY OF THE INVENTION

The present invention provides a rotary apparatus having an improved driving system which, while particularly well adapted for use in volumetric apparatus of the type described above, can also be used in other types of rotary apparatus in which it is desired to rotate an assembly in discrete or temporally spaced increments, rather than continuously. The apparatus includes a stationary assembly, such as a framework, and a rotary assembly mounted for relative rotation thereon and including rotary shaft means. A reciprocating type drive means, such as a piston and cylinder assembly, provides the ultimate driving force for rotating the rotary assembly. A driven member is connected to the shaft means, and link means drivingly connect the driven member to the drive means. The link means is arranged to rotate the driven member in a first direction upon reciprocation of the drive means in a first directional mode and to rotate the driven member in a second direction opposite the first upon reciprocation of the drive means in a second directional mode opposite the first mode. A clutch interconnects the driven member and the shaft means and is operative, upon rotation of the driven member in the first direction to cause rotation of the shaft means therewith, and upon rotation of the driven member in the second direction, to permit relative rotation between the driven member and the shaft means.

The drive means is preferably a pneumatic piston and cylinder assembly having one member, normally the cylinder, fixed with respect to the stationary assembly, and the other member, ordinarily the piston, reciprocable with respect to the fixed member. The driven member is preferably a driven wheel such as a sprocket, pulley, or the like, and the link means comprises an elongate flexible chain, belt, or other appropriate body for engagement with the driven wheel. This chain or the like has one end secured to the reciprocable member of the piston and cylinder assembly, a mid portion extending circumferentially about a portion of the periphery of the driven wheel in contact therewith, and the other end secured to the stationary assembly. The link means further includes tensioning means, such as a spring interposed between said other end of the chain and the stationary assembly, to keep the chain taut between the ends thereof.

Accordingly, as the piston makes a stroke in the first directional mode, preferably away from the driven wheel, it will rotate that wheel via the chain, and the clutch will cause the shaft means to rotate therewith. On the return stroke of the piston in the second directional mode, the driven wheel rotates upon the shaft, the spring insuring that the chain remains taut and returns to its proper starting position. Accordingly, the shaft is rotated in discrete or temporally spaced increments.

By use of a drive means which is entirely separate from that for the remainder of a packaging apparatus in which the volumetric is incorporated, and more specifically a piston and cylinder assembly, it is possible to provide just enough power to properly rotate the rotary assembly but not enough to cause damage to the apparatus in the event of a jam. More particularly, by the use of suitable valving means controlling the pressure of fluid applied to the drive piston, it is possible to design the apparatus so that, should there by a jam of the rotary assembly, the air being supplied to the drive cylinder will not be sufficient to reciprocate the piston.

In preferred embodiments, the apparatus further comprises an indexing synchronization means for positively stopping rotation of the shaft means generally at the end of each stroke of the drive piston in the first directional mode. By proper design of the indexing synchronization means, the rotary assembly can be stopped in a predetermined position at the end of each increment of rotation, and such position will precisely locate one of the cups of the rotary assembly of the volumetric apparatus at the discharge station and another of said cups at the filling station. In other words, the indexing synchronization means prevents the rotary assembly from moving past the desired sequential stopping point by virtue of momentum created during the drive stroke of the drive piston. By the same token, this indexing synchronization means will operate to return the apparatus to proper alignment and indexing sychronzation with the drive piston and cylinder assembly within one stroke cycle after a jam has been cleared.

More specifically, the indexing synchronization means includes an indexing wheel mounted on the shaft means for joint rotation therewith and having a generally radially outwardly facing peripheral indexing surface including a number of generally S-shaped portions, corresponding to the number of cups in the rotary assembly. A second or indexing piston and cylinder assembly has one member, normally the cylinder, fixed with respect to the stationary assembly and the other member, normally the piston, reciprocable with respect to the fixed member generally toward and away from the indexing surface. Detent means are carried by the end of the reciprocable member and designed so that, when such member is extended toward the cam surface, the detent means can ride along the convex segment of the S-shaped portion then generally opposed to the detent means to permit rotation of the cam wheel and thus of the shaft means. However, when the detent means engages the concave segment of that S-shaped portion, it will stop rotation of the indexing wheel and shaft means. Control means are provided to properly correlate the timing of the strokes of the two piston and cylinder assemblies, and more particularly, to cause the second piston to be temporarily retracted away from the indexing surface, i.e. drawn out of the concave segment in which it was engaged, just before or simultaneously with the beginning of a drive stroke of the first piston to permit the shaft to begin rotating.

Accordingly, it is a principal object of the present invention to provide an improved driving system for volumetrics and other rotary apparatus requiring rotation in discrete or temporally spaced intervals.

Still another object of the present invention is to provide such an apparatus which utilizes a reciprocating drive means to effect such rotation via a driven wheel and link means.

Still another object of the present invention is to provide an improved indexing synchronization means for such an apparatus.

Still other objects, features, and advantages of the present invention will be made apparent by the following detailed description of the preferred embodiments, the drawings, and the claims.

BRIEF DESCRIPTION OF THE DRAWINGS

FIG. 1 is a side perspective view, with parts broken away, of a food packaging apparatus including volumetric apparatus according to the present invention.

FIG. 4 is a plan view of the indexing synchronization means taken along the lines 4—4 in FIG. 2.

DESCRIPTION OF THE PREFERRED EMBODIMENTS

Figure 2:
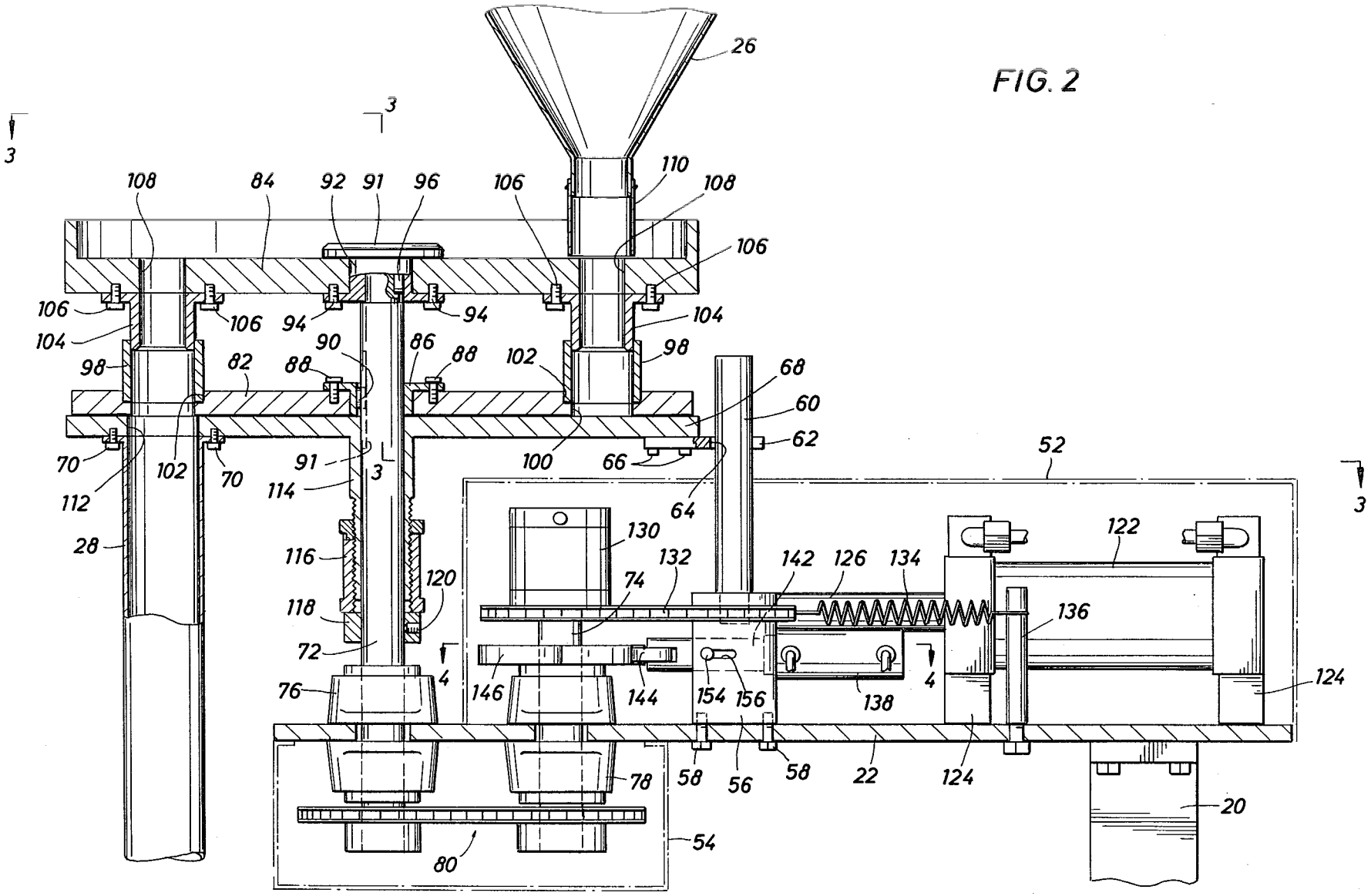
FIG. 2 is an enlarged partial sectional-partial elevational view of the volumetric apparatus of FIG. 1.

Referring first to FIG. 1 there is shown, in simplified form, a complete packaging apparatus including volumetric apparatus 10 according to the present invention which successively measures out a predetermined volume of small items such as beans, nuts, candles, or the like and delivers each such measured volume of goods to a respective bag 12 being formed by the packaging apparatus, generally indicated at 14. Apparatus 14 includes a stationary framework, a continuation of which forms the stationary framework for volumetric apparatus 10. This framework includes a lowermost base plate 16 and a pair of parallel spaced apart plates 18 extending upwardly therefrom. Interconnecting the upper ends of plates 18 is an intermediate horizontal base plate (not shown) which in turn supports a plurality of legs 20 comprising a part of the framework of volumetric apparatus 10. The latter framework further includes an upper base plate 22 which in turn supports, among other stationary parts to be described more fully below, a bracket 24 which carries a conical hopper 26, and a discharge tube 28 co-axially aligned with the bags 12 being formed by apparatus 14.

Apparatus 14 is designed, in a manner well known in the art, to form bags 12 from a roll of sheet material 30. Roll 30 is mounted on a reel carried by brackets 32 which in turn are rigedly mounted on plates 18 of the stationary framework. Roll 30 is fed over a plurality of elongate rollers in most such devices. However, for simplicity of illustration, a single such roller 34 has been shown herein. From such roller or rollers, the sheet material is passed through a forming collar 36, of a type well known in the art, which brings the opposite sides of the sheet material into overlapping relation and gradually forms the sheet material into a tube 38. Heat sealing or other such means (not shown) located within or below collar 36 join the overlapping side portions of the sheet material to form a longitudinal seam along tube 38.

A second set of heat sealing heads 40 are mounted on means (not shown) which cause them to reciprocate toward and away from each other against the tube 38 therebetween to seal off tube 38 transversely so as to separate the individual bags 12. The heat sealing heads 40 are carried by means which also cause them to move upwardly when separated and downwardly when urged together so that such transverse seals are formed at longitudinally spaced locations. Such action of the heads 40 further serves to pull tube 38 and the sheet material from roll 30 along the aforementioned path and through forming collar 36.

The volumetric apparatus 10 must deposit a measured volume of the goods being packaged in tube 38 after the lowermost seal of the bag in question has been formed by heads 40 but before the upper end of that bag has been sealed by heads 40. The seal formed at the upper end of that bag will also constitute the seal for the lower end of the next successive bag, and volumetric apparatus 10 will then deposit another pre-measured volume of goods in tube 38 above the latter seal. Heads 40 may also be designed to cut the bags 12 apart from one another after the seals have been formed, or the bags may be separated subsequently by other means.

In order to coordinate the timing of the various operating parts of the overall apparatus shown in FIG. 1, a small electric motor 42 is provided which rotates a shaft 44. Shaft 44 in turn carries a plurality of cam wheels 46, each of which has an eccentric portion which may contact a respective trigger to close a respective electrical switch 48. Each of these switches 48 controls the function of a respective one of the moving assemblies of the overall apparatus through circuits at least partially contained in a housing 50 mounted on the outer side of one plate 18. Accordingly, by proper sizing and positioning of the eccentric portion of each of the cam wheels 46, proper timing of these functions can be established.

Figure 3:
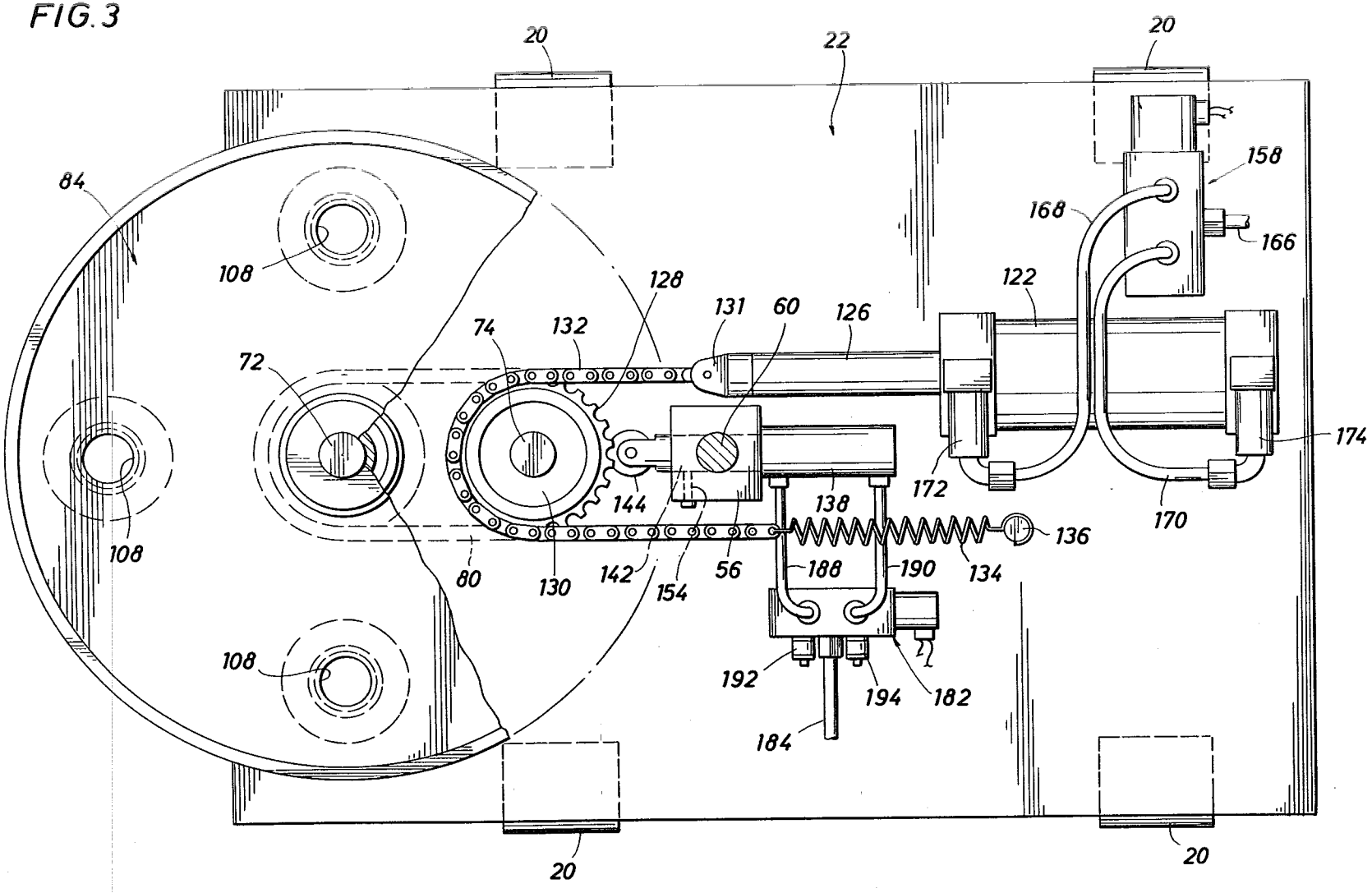
FIG. 3 is a plan view taken along the lines 3—3 in FIG. 2.

Referring now to FIGS. 2 and 3, the volumetric apparatus is shown in greater detail. The volumetric apparatus includes a stationary assembly or framework which, as previously mentioned, includes a plurality of legs 20 for supporting the volumetric framework upon the framework of the packaging apparatus 14 therebelow, and a horizontal base plate 22. Rigidly secured to the upper side of base plate 22 is a housing or cover 52 which encases the major portion of the drive system to be described more fully below. Another cover or housing 54 is similarily secured to the underside of plate 22 to enclose the lower ends of two shafts and the apparatus by which they are connected. The stationary framework further includes a mounting block 56 ridigly affixed to plate 22 by screws 58 and extending upwardly from plate 22. A post 60 is in turn rigidly affixed to block 56 and extends further upwardly therefrom. A positioning plate 62 having an aperture 64 therein for receipt of post 60 is secured by screws 66 to a large disc 68, also forming a part of the stationary assembly. Since the plate 62 is secured to disc 68 eccentrically of the centerline of the latter, and in turn has its aperture 64 receiving stationary post 60, plate 62 and post 60 together serve to fix disc 68 against rotation with the rotary assembly to be described below. However, the relatively loose sliding fit between aperture 64 and post 60 permits raising and lowering of disc 68 in a manner also described more fully below.

The discharge tube 28 has a radially outwardly extending annular flange at its upper end by which it is secured to disc 68 by screws 70. Tube 28 may be adjustably supported on the stationary framework of packaging apparatus 14 so that it cooperates with plate 62 and post 60 to prevent rotation of disc 68, but in any event, forms a part of the stationary assembly of the apparatus.

The volumetric apparatus also comprises a rotary assembly including primary and secondary shafts 72 and 74 respectively. Shaft 72 is fixed longitudinally in plate 22 but supported for rotation therein by a bearing assembly 76, while shaft 74 is similarly rotatably supported in plate 22 by a bearing assembly 78. The lower ends of shaft 72 and 74 are drivingly connected to one another for joint rotation by a conventional chain and sprocket arrangement 80. The rotary assembly further includes a pair of parallel spaced apart discs 82 and 84 mounted on the upper portion of shaft 72. The lower of these discs 82 is positioned just above stationary disc 68 in sliding engagement therewith. Disc 82 has a central opening which receives the hub portion of an annular mounting ring 86, a radial flange of which is secured to disc 82 by screws 88. Mounting ring 86 in turn receives shaft 72 in its central opening and is keyed to the shaft by a key 90 so that disc 82 and ring 86 will rotate in unison with shaft 72. Disc 68 supports disc 82 longitudinally on shaft 72. Disc 84 is similarly connected to the upper end of shaft 72 by a mounting ring 92 whose annular hub extends into a central opening in disc 84 and whose radial flange is secured to that disc by screws 94. Ring 92 is keyed to shaft 72 by a key for joint rotation of shaft 72 and ring 92 and disc 84. A stop plate 91 rigidly affixed to disc 84 across the upper end of its central opening overlies the upper end of shaft 72 to support disc 84 longitudinally thereon.

Four cup assemblies are mounted between discs 82 and 84, the discs thus forming a carrier for the cup assemblies. The latter are spaced radially outwardly from shaft 72 and symmetrically circumferentially spaced from one another about the discs. Each cup assembly comprises a lower cylindrical member 98 aligned with a respective aperture 100 in disc 82 and supported on that disc by its lower end, which rests in a counterbore 102 of the respective aperture 100. An upper member 104 of each cup assembly has a generally cylindrical portion of slightly smaller diameter than member 98 for sliding telescopic receipt therein and a radially outwardly extending annular flange at its upper end by which it is secured to disc 84 by screws 106. Each of the upper cup members 104 is aligned with a respective aperture 108 in disc 84.

Thus, each of the aligned apertures 100, cup members 98 and 104, and apertures 108 form a respective receptacle which, when filled, will measure a specified volume of small solids. The small solids are delivered to each such receptacle when it is positioned beneath hopper 26, the lower end of the receptacle being closed off by stationary disc 68 abutting the underside of rotary disc 82. Then, as the discs 82 and 84 are rotated by shaft 72, thereby moving the receptacle just filled away from hopper 26, the small solid goods are leveled at the upper extremity of such receptacle by a flexible skirt 100 which extends downwardly from hopper 26 to abut the upper side of disc 84. As the discs 82 and 84 continue to rotate, the receptacle filled as described above will eventually come into a position in alignment with the discharge tube 28. At that position, stationary disc 68 has an opening 112 which permits the goods to fall into the discharge tube. In the meantime, successive receptacles will have been filled as they pass under hopper 26, and their contents will eventually be discharged into tube 28 in the same manner.

It can be appreciated that, in order to insure that each receptacle is completely filled from hopper 26 and completely discharged into tube 28, rotation of shaft 72 and the parts carried thereby should not be continuous, but rather in increments temporally spaced to provide a pause in the rotary motion when a receptacle is aligned with hopper 26 or tube 28. The drive system to be described more fully below provides for such incremental rotation, and the cup assemblies 98, 104 and aligned apertures 100, 108 are positioned so that, when one such cup assembly is aligned with hopper 26, another will be aligned with tube 28.

The volume of each cup assembly and its aligned apertures can be adjusted by raising or lowering discs 82 and 68 on shaft 72. More specifically, disc 68 has a generally cylindrical sleeve 114 extending downwardly therefrom in surrounding relation to shaft 72. The lower end of sleeve 114 is externally threaded to receive an adjusting nut 116. The lower end of nut 116 rests on a support ring 118 fixed on shaft 72 by a set screw 120. Accordingly, disc 68 is supported on shaft 72 via sleeve 114, nut 116, and ring 118, but shaft 72 may still rotate with respect to disc 68 since the upper edge of ring 118 is slidable against the lower edge of nut 116. To increase or decrease the volume of the cup assemblies 98, 104, nut 116 is rotated in the appropriate direction to either raise or lower sleeve 114 with respect thereto. This in turn raises or lowers disc 68 as well as disc 82 resting thereon, such movement being permitted by the sliding telescopic connection between cup members 98 and 104 and the length of keyway 91 receiving key 90. Even greater adjustments can be made by loosening screw 120 and moving support ring 118 along shaft 72.

The drive system for incrementally rotating shaft 72 includes, as the ultimate drive means or engine, a pneumatic piston and cylinder assembly, the cylinder 122 of which is fixedly mounted on plate 122 by support blocks 124. The piston (see 123 in FIG. 5) reciprocable in cylinder 122 has an elongate extension 126 extending lengthwise out of cylinder 122 at the end thereof closest to secondary shaft 74. Shaft 74 has a driven member in the form of a sprocket wheel 128 mounted co-axially thereon by means of a clutch device 130. The outer end of extension 126 forms a clevis 131 to which is secured one end of a flexible chain 132. Chain 132 extends outwardly away from extension 126 generally toward sprocket wheel 128, around sprocket wheel 128, and then away from sprocket wheel 128 generally parallel to extension 126, its other end being secured via a tension spring 134 to a rod 136 rigidly affixed to plate 22. Spring 134 keeps chain 132 taut between the ends thereof and in firm engagement with a portion of the outer periphery of sprocket wheel 128 while still permitting rotation of that sprocket wheel as described below.

The clutch mechanism 130 may be of any conventional type and is designed, upon rotation of sprocket wheel 128 in a clockwise direction as viewed in FIG. 3, to cause shaft 74 to rotate therewith, but upon rotation of sprocket wheel 128 in the counterclockwise direction, to permit relative rotation between the sprocket wheel and shaft 74. Accordingly, as piston rod extension 126 moves to right as viewed in FIG. 3, i.e. inwardly with respect to cylinder 122, it rotates sprocket wheel 128 via chain 132, while clutch mechanism 130 in turn causes shaft 74 to rotate along with the sprocket wheel. The sprocket assembly 80 interconnecting shafts 72 and 74 in turn causes this rotational motion to be transmitted to shaft 72 and thus to the entire rotary assembly including plates 82 and 84 and cup assemblies 98, 104. When piston rod extension 126 moves in the reverse directional mode, i.e outwardly from cylinder 122 and toward the left as viewed in FIG. 3, spring 134 will contract keeping chain 132 taut and thereby causing sprocket wheel 128 to rotate back in a counterclockwise direction. However, during the last mentioned rotation, clutch mechanism 130 causes the sprocket wheel 128 to rotate on shaft 74, the latter—and thus the entire rotary assembly—remaining stationary.

It can thus be seen that repeated reciprocations of piston rod extension 126 will cause rotation of the rotary assembly in temporally spaced increments. By proper choice of the stroke length of the drive piston and cylinder assembly, these increments can be caused to be approximately 90° each, so that each increment of rotation moves one of the four symmetrically spaced receptacles of the rotary assembly into alignment with the hopper 26 and a diametrically opposite one of the receptacles into alignment with the discharge tube 28.

However, because of the momentum of the rotary assembly, it would be difficult to ensure precise alignment of the receptacles with the hopper and discharge tube solely by means of the drive system described above. Furthermore, should there be a jamming of the rotary assembly during operation, such drive system might be thrown out of synchronization so that, after clearing of the jam and resumption of normal operation, the receptacles would not even be approximately aligned with the appropriate parts of the stationary assembly at the ends of the stroke of the drive piston and cylinder assembly.

For these reasons, an indexing synchronization system is provided to positively stop each increment of rotation when the appropriate receptacles are precisely aligned with the hopper and discharge tube and also to return the apparatus to proper synchronization, should such be temporarily lost due to a jam or the like.

Referring now to FIG. 4 in conjunction with FIGS. 2 and 3, the indexing synchronization means includes a second pneumatic piston and cylinder assembly, the cylinder 138 of which has an integral threaded extension 140 projecting from one end thereof and threaded into block 56 of the stationary assembly to mount cylinder 138 thereon. The piston of the assembly has an extension 142 extending outwardly from the cylinder 138 and generally toward shaft 74. Extension 142 is slidably mounted in block 56. The outer end of extension 142 forms a clevis in which a detent roller 144 is mounted for idling rotation about an axis parallel to shaft 74. The timing synchronization system further includes an indexing wheel 146 mounted on shaft 74 in alignment with detent 144 and keyed to shaft 74 as indicated at 148 for joint rotation therewith. The radially outwardly facing peripheral surface of cam wheel 146 serves as an indexing surface, and includes four identical generally S-shaped portions, each of which includes a relatively long convex segment 150 and a relatively short concave segment 152 contiguous the convex segment of the next adjacent S-shaped portion of the surface.

Extension 142 has a relatively short stroke, the length of which is precisely controlled by stop means in the form of a screw 154 extending radially outwardly from extension 142 and through a slot 156 in block 56, the slot being elongated in the direction of movement of extension 142. Just prior to each driving stroke of the drive piston and cylinder assembly, i.e. each movement of extension 126 inwardly toward cylinder 122, the second piston and cylinder assembly is caused to operate, by control means be described more fully below, to retract extension 142 inwardly toward cylinder 138 thereby disengaging detent 144 from the indexing surface of wheel 146. This permits the wheel, and thus the attached shaft 74, to begin rotating with the sprocket wheel 128 upon initiation of the drive stroke of extension 126 of the drive piston and cylinder assembly.

As such drive stroke continues, extension 142 of the second piston and cylinder assembly is extended back toward the indexing wheel and will engage one of the convex segments 150. Detent 142 will rotate along such convex segment while urged thereagainst by the indexing piston and cylinder assembly, thus permitting continued rotation of wheel 146 and shaft 74 during the drive stroke of extension 126. As the latter extension reaches the end of its drive stroke, detent 144 will enter the concave segment 152 of the S-shaped portion of the indexing surface with which it is then engaged thereby stopping rotation of wheel 46 and shaft 74. Detent 144 remains in such segment 152 during the return stroke of piston rod extension 126 of the drive assembly until just prior to the initiation of a second drive stroke thereof, at which time it is again retracted by extension 142 to permit the next rotational increment to begin. It can be seen that, by proper positioning of indexing wheel 146 on shaft 74 relative to the positions of the cup assemblies 98, 104 with respect to shaft 72, the timing synchronization system can be designed to stop each increment of rotation at a point at which one such cup assembly is precisely aligned with discharge tube 28 and another such assembly is aligned with hopper 26.

As previously mentioned in connection with FIG. 1, the relative timing of the operation of various parts of the overall apparatus is controlled by a plurality of timing cam wheels 46 mounted on a common shaft 44 and each controlling the closing and opening of a respective electrical switch. Referring now to the schematic shown in FIG. 5, these timing cams include a cam **46*a* for timing the operation of cylinder 122 and its piston 123, i.e. the drive piston and cylinder assembly, and a cam 46*b* for controlling the timing of the second cylinder 138 and its piston 139. Piston and cylinder assembly 123, 122 is immediately controlled by a solenoid valve assembly shown in FIG. 3 as a composite unit 158, and in the schematic of FIG. 5, as including the solenoid proper 158*a* and the switching valve 158*b* which is operatively controlled by solenoid 158*a***.

Compressed air from any suitable source is directed by a conduit 160 through a primary regulator valve 162 which controls the pressure of the air emitted therefrom. From valve 162, conduit 160 leads to a manifold 164 where it communicates with a second conduit 166 communicating with valve **158*b*. Valve 158*b* has two outlet lines 168 and 170 each leading to a respective end of cylinder 122, i.e. communicating with cylinder 122 on opposite sides of piston 123. Lines 168 and 170 contain respective flow control valves 172 and 174** for controlling the rate of fluid flow through the respective ones of the outlet lines.

Figure 5:
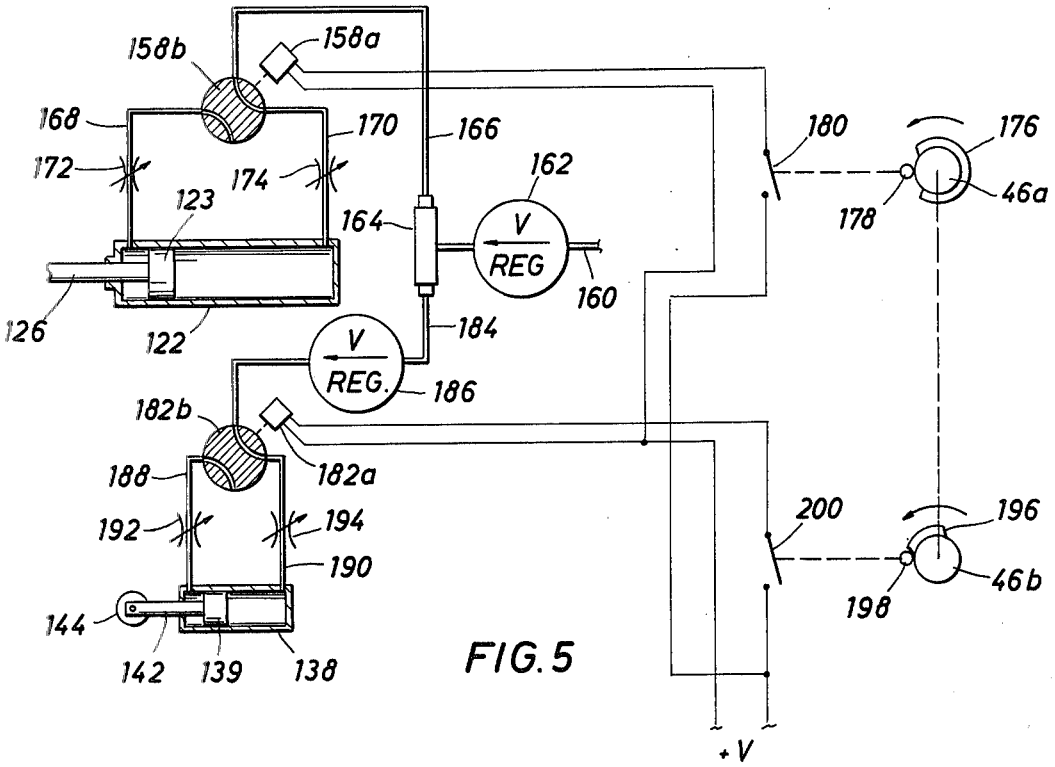
FIG. 5 is a schematic of the piston and cylinder assemblies and their controls.

When solenoid **158*a* is de-energized, valve 158*b* is in the position shown in FIG. 5 wherein conduit 166 is connected to line 170 to the right hand end of cylinder 122 so as to extend piston 123 and its rod extension 126 generally toward shaft 74, and conduit 168 communicating with the left end of cylinder 122 is vented to atmosphere. FIG. 5 shows the apparatus just prior to the end of a return stroke of piston 123. As the piston reaches the end of its return stroke, i.e. its stroke in the left hand direction generally towards shaft 74, cam 46*a* will have rotated to a position such that its eccentric portion or lobe 176 will contact a trigger 178 operative to close a switch 180 which completes a circuit to solenoid 158*a*. Energization of solenoid 158*a* operates to switch valve 158*b* to its other position wherein the pressurized air conduit 166 is communicated with line 168 leading to the left hand end of cylinder 122, and line 174 communicating with the right hand end of cylinder 122 is vented to atmosphere. This will initiate a drive stroke of piston 123, i.e. a stroke in the right hand direction, generally away from shaft 74. When the end of the drive stroke is reached, lobe 176 of cam 46*a* will disengage trigger 178 thus opening switch 180. This will break the circuit to solenoid 158*a* which in turn will cause valve 158*b* to return to the position shown in FIG. 5 to initiate a return stroke of piston 123**.

The assembly comprising cylinder 138 and its piston 139 is operated in much the same manner. More specifically, such operation is controlled by a solenoid valve shown in FIG. 3 as a composite unit 178 and in FIG. 5 as comprising a solenoid **178*a* operatively associated with a switching valve 178*b*. As previously mentioned, compressed air from any suitable source is directed by conduit 160 through regulator valve 162 and into manifold 164. A conduit 184 directs air from manifold 164 to valve 182*b*. A second regulator valve 186 is disposed in conduit 184 to further decrease the pressure of air entering valve 182*b*. Valve 182*b* has two outlet lines 188 and 190 communicating with opposite ends of cylinder 138**.

Respective muffler devices 192 and 194 are operatively associated with lines 188 and 190 and/or adjacent ends of cylinder 138. Devices 192 and 194 are of a well known type commercially available, the usual purpose of which is to muffle the noise produced by the reciprocating of a piston. However, with a small stroke, low pressure assembly such as piston and cylinder 139, 138, such devices may be adjusted to effectively provide for a regulation of the flow rate of air into the cylinder, i.e. to perform the same function with respect to cylinder 138 as do valves 172 and 174 with respect to cylinder 122.

With valve **182*b* in the position shown in FIG. 5, line 184 is communicated with line 190 thus supplying compressed air to the right hand end of cylinder 138, while line 188 is vented to atmosphere. Thus, valve 182*b* is in position to effect a return stroke of piston 139, i.e. a stroke in the left hand direction so as to urge detent 144 toward and/or against the indexing surface of wheel 146. This position of valve 182*b* is assumed when the associated solenoid 182*a* is not energized. When lobe 196 of cam 46*b* rotates to a position such that it engages trigger 198, switch 200 will be closed completing a circuit to solenoid 182*a*. This will cause valve 182*b* to move to its other position wherein line 184 is communicated with line 188 and line 190 is vented to atmosphere so as to effect a stroke of piston 139 in the right hand direction to retract the detent 144 away from the indexing surface of wheel 146**.

The configuration and relative positions of cams **46*a* and 46*b* are designed to effect the desired relative timing of the strokes of pistons 123 and 139, and this effect is further enhanced by the flow control valve 172, 174, 192, and 194. In particular, and recalling that cams 46*a* and 46*b* are carried by a common rotary shaft 44, (FIG. 1) lobe 196 of cam 48*b* is positioned to engage its respective trigger 198 just before lobe 176 of cam 48 reaches its trigger 178. Accordingly, the retraction stroke of piston 139, i.e. the stroke in the right hand direction as viewed in the figures, will be initiated just prior to the drive stroke of piston 123, also in the right hand direction. However, because lobe 176 of cam 46*a*** is much longer (i.e. greater in circumferential extent) than lobe 196 of cam 46*b*, solenoid 158*a* will remain energized substantially longer than solenoid 182*a*. Additionally, the flow control valve 172 in line 168, which controls the rate of air flow into cylinder 122 on the drive stroke, is designed to provide for a relatively low volumetric flow rate, and thus, relatively slow movement of piston 123.

Conversely, muffler device 192, which acts as a flow control valve for line 188 to control the volumetric flow rate of air into cylinder 138 on the retraction stroke, provides for a relatively high flow rate and thus relatively fast movement of piston 139. This ensures completion of such retraction stroke before lobe 196 disengages trigger 198. Accordingly, piston 139 will be quickly retracted, drawing detent 144 away from cam wheel 146, just prior to the initiation of the drive stroke of piston 123 so that, when such drive stroke begins, shaft 74 will be free to being rotating. However, because the retraction stroke of piston 139 is relatively fast and that of piston 123 relatively slow, piston 139 will begin its return stroke before the end of the drive stroke of piston 123. More specifically, when lobe 196 of cam 48*b* disengages trigger 198 opening switch 200 and de-energizing solenoid 182*a*, valve 182*b* will reverse the directions of air flow into and out of cylinder 138 as previously described.

Muffler device 194, which acts as a flow control valve for line 190 thereby controlling the speed of movement of piston 139 on such return stroke, is adjusted to provide a relatively low volumetric flow rate. This provides a relatively slow return stroke of piston 139 so that detent 144 will not engage cam wheel 146 with a sharp blow. The relatively large size of the unlobed portion of cam 46*b* ensures solenoid 182*a* will remain de-energized for a sufficient time to permit such a slow return stroke. Meanwhile, the relatively great circumferential extent of lobe 176 of cam 46*a* permits solenoid 158*a* to remain energized for a sufficient time to accomodate the slow drive stroke of piston 123 caused by flow control valve 172.

The speeds of movement of pistons 123 and 139, as determined by flow control valve 172, 192, and 194, are preferably chosen such that detent 144 will begin to roll against the indexing surface of wheel 146 while piston 123 is still in its drive stroke and will enter the concave segment 152 of the engaged portion of said cam surface at approximately the same time as piston 23 reaches the end of its drive stroke but while solenoid 182*a* is still in a de-energized state. The unlobed portion of cam 46*b* is sized and positioned so that solenoid 182*a* will further remain in such de-energized condition during virtually the entire return stroke of piston 123. Thus, air will continue to be admitted into the right hand end of cylinder 138 through line 190 so as to urge piston 139 toward shaft 74 and retain detent 144 in the then engaged concave segment 152 of the indexing surface of wheel 146 so as to positively prevent rotation of shaft 74 during the return stroke of piston 123.

The unlobed portion of cam 46*a*, which is in alignment with trigger 178 during the return stroke of piston 123 is necessarily of relatively short circumferential extent. Accordingly, flow control valve 174 is designed or adjusted to provide a relatively fast volumetric flow rate through line 170 and thus a relatively fast return stroke of piston 123. At the end of the return stroke of piston 123, lobe 196 of cam 46*b* will again engage trigger 198 to cause retraction of detent 144 from the engaged concave segment 152 of the indexing surface of wheel 146 to permit another operational cycle to begin.

Air regulator valve 162 is designed and/or adjusted to provide a sufficient air pressure through conduit 166 to operate piston 123 under normal circumstances, but not sufficient to move the piston against the resistance which would be caused in the event of jam of the rotary portion of the apparatus. In other words, cam 46*a* may continue to rotate causing successive energization and de-energizing of solenoid 158*a* and corresponding changes in position of valve 158*b*, but piston 123 will not move. Thus, the drive means comprised of cylinder 122 and piston 123 will be effectively deactivated so that it cannot cause damage to the rotary assembly of the apparatus or the interconnecting linkage means by continued operation during a jam.

When such a jam is cleared, the position of piston 123, which would have remained stationary during the jam, may not correspond to its normal position within cylinder 122 with respect to a given position of cam 46*a* with respect to trigger 178. Thus, the drive means 122, 123 may be temporarily thrown out of synchronization with the rotary assembly of the apparatus by such a jam. However, during the next operating cycle after the clearing of such a jam, detent 144, upon being urged against one of the concave segments 152 of the indexing surface of wheel 146, will retain that wheel and the attached shaft 74 against further rotation—with one of the cup assemblies 98, 104 in proper alignment with tube 28—until piston 123 reaches the end of a return stroke. Thus, upon one operating cycle after clearing of a jam, piston and cylinder assembly 139, 138, in cooperating with indexing wheel 146 will cause the drive piston and cylinder 123, 122 to return to synchronization with the remainder of the apparatus.

Another of the advantages of the apparatus shown in FIGS. 1–5, is that, by designing the rotary assembly of the apparatus with a pair of parallel shafts 72 and 74, it is possible to shorten the distance between the point at which the goods being measured are discharged into tube 28 and the point at which they enter the bag or container being formed. This lessens the necessary delay time between rotational increments of such rotary assembly. However, this arrangement does require the use of two separate shafts, each mounted in the stationary assembly of the apparatus by its own respective bearing assembly 76 or 78, as well as the interconnecting chain and sprocket arrangements 80.

Figure 6:
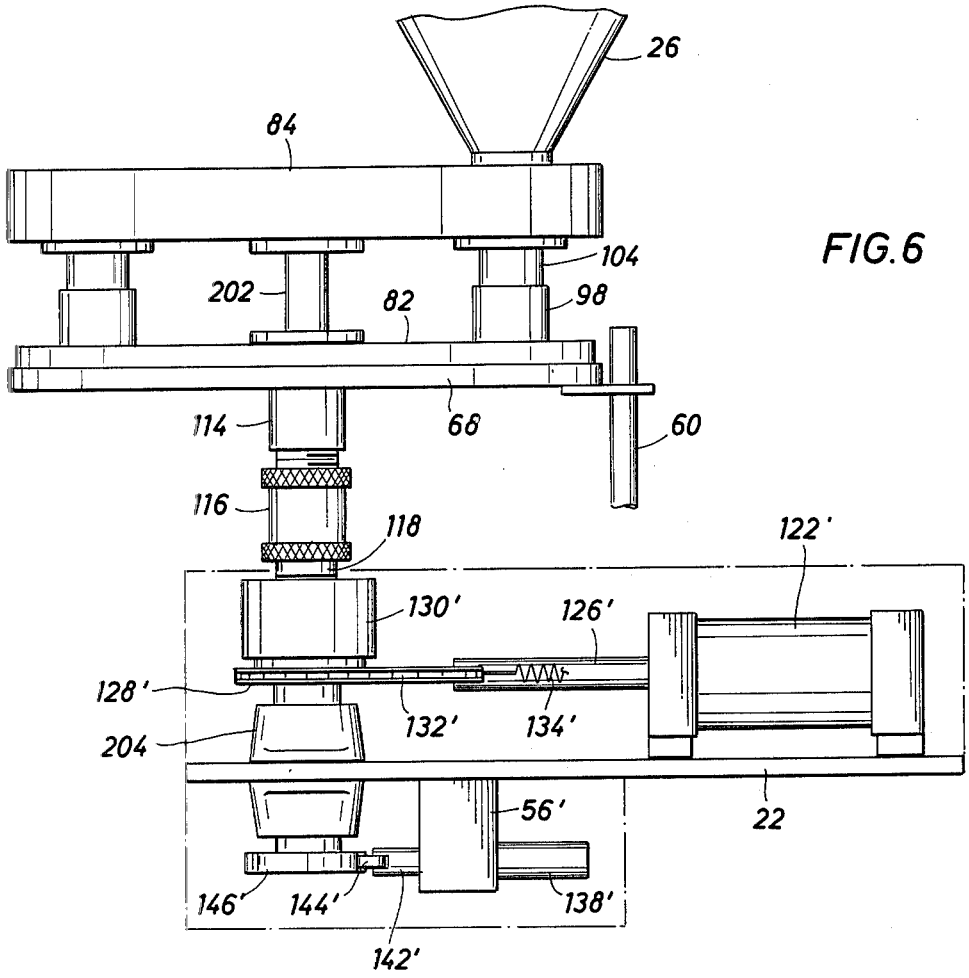
FIG. 6 is a side view of a second embodiment of volumetric apparatus.

Thus, in those instances in which it is desirable to optimize mechanical simplicity, and thus minimize the cost of the apparatus, at the expense of vertical length and delay time, a second embodiment of the invention shown in FIG. 6 can be employed. Those parts of the apparatus of FIG. 6 which are substantially identical to the analogous parts of the first embodiment are designated with like reference numerals. In particular, the apparatus includes a stationary assembly, only partially shown in FIG. 6, including a plate 22, a rod 60 extending upwardly therefrom, a stationary disc 68, and a conical hopper 26. The rotary assembly likewise includes a pair of vertically spaced apart rotary discs 82 and 84 with a number of circumferentially spaced apart cup assemblies 98, 104 extending therebetween. However, the rotary assembly includes only a single shaft 202 on which discs 82 and 84 are mounted in the same manner as on shaft 72 of the first embodiments. Likewise, the vertical dimensions of the cup assemblies may be varied by adjusting discs 68 and 82 upwardly or downwardly with respect to disc 84 by a threaded sleeve and nut arrangement 114, 116, 118 substantially identical to that of the first embodiment.

Shaft 202 is supported on plate 22 for rotation about its own axis by bearing assembly 204. Above bearing assembly 204, a sprocket wheel 128', substantially identical to wheel 128 of the first embodiment, is mounted on shaft 202 by a clutch mechanism 130' which provides for joint rotation of shaft 202 and sprocket wheel 128' in the clockwise direction when viewed from above, but permits relative rotation of sprocket wheel 128' with respect to shaft 202 in the counterclockwise direction. A drive means including a pneumatic cylinder 122' and a piston (not shown) having an extension 126' is linked to the rotary assembly by a chain 132' which extends from the outer end of extension 126' around the opposite side of sprocket wheel 128', and back toward a mounting post (not shown) to which it is attached by a tension spring 134'. Thus, the drive and linkage means of the embodiment of FIG. 6 will operate in substantially the same manner as those of the first embodiment to cause rotation of shaft 202 via sprocket wheel 128' and chain 132' when extension 126' is retracted away from the shaft in its drive stroke. Such rotation is in temporally spaced increments interrupted by return strokes of the drive piston and its extension 126', such interruptions being permitted by clutch mechanism 130'.

The embodiment of FIG. 6 is likewise provided with an indexing synchronization system which is substantially identical to that of the first embodiment except that it is mounted on the single shaft 202 of the rotary assembly below plate 22. More specifically, the indexing synchronization system includes a second cylinder 138' ridgily affixed to a mounting block 56' extending downwardly from plate 22. The piston (not shown) within cylinder 138' has an extension 142' slidably mounted in block 56' and carring a roller type detent 144' on its outer end. Roller 144' is engagable with the radially outwardly facing peripheral indexing surface of a cam wheel 146' which is identical in configuration to wheel 145 of the first embodiment, and which is rigidly affixed to the lower end of shaft 202. The operations of cylinders 122' and 138' and their associated pistons are controlled by circuitry and valving substantially identical to that illustrated in FIG. 5. Thus, just prior to the initiation of each drive stroke of piston extension 126', detent 144' is quickly retracted from wheel 146' to permit shaft 202 to begin rotating. Then, during the remainder of the drive stroke of piston extension 126', detent 144' is gradually returned to and engages wheel 146' and rolls along a convex segment of its indexing surface, entering an adjacent concave segment and positively stopping rotation of shaft 202 at approximately the same time as piston extension 126' completes its drive stroke.

Numerous other modifications of the preferred embodiments described above will be apparent to those of skill in the art. Accordingly, it is intended that the scope of the present invention be limited only by the claims which follow.

I claim:

1. Rotary apparatus comprising:

a stationary assembly;

a rotary assembly mounted on said stationary assembly for rotation relative thereto and including rotary shaft means;

reciprocating drive means comprising a first pneumatic piston and cylinder assembly, said piston and cylinder assembly having one member fixed with respect to said stationary assembly and another member reciprocable with respect to said fixed member;

a driven member comprising a sprocket wheel mounted on said shaft means;

link means drivingly connecting said driven member to said drive means for rotation in a first direction upon movement of said reciprocable member of said first piston and cylinder assembly generally away from said sprocket wheel and for rotation in a second direction opposite the first direction upon reciprocating movement of said reciprocable member generally away from said sprocket wheel, said link means comprising a chain having one end secured to said reciprocable member of said first piston and cylinder assembly, a mid portion extending circumferentially about a portion of the periphery of said sprocket wheel in contact therewith, and the other end secured to said stationary assembly, a tension spring interconnecting said other end of said chain to said stationary assembly to keep said chain taut between said ends thereof;

clutch means interconnecting said sprocket wheel and said shaft means and operative upon rotation of said driven member in said first direction to cause rotation of said shaft means therewith, and upon rotation of said driven member in said second direction, to permit relative rotation between said driven member and said shaft means, whereby said shaft means is rotated by said drive means in temporally spaced increments; and indexing synchronization means comprising an indexing wheel mounted on said shaft means for joint rotation therewith and having a generally radially outwardly facing peripheral indexing surface including at least one convex segment and at least one concave segment, a second pneumatic piston and cylinder assembly operatively associated with said shaft means for positively stopping rotation of said shaft means generally at the end of each stroke of said reciprocable member of said first piston and cylinder assembly generally away from said sprocket wheel, said second piston and cylinder assembly having one member fixed with respect to said stationary assembly and the other member reciprocable with respect to said fixed member generally toward and away from said indexing surface, and detent means carried by the end of said reciprocable member of said second piston and cylinder assembly and adapted, when extended toward said indexing surface, to ride along said convex segment to permit rotation of said indexing wheel and to engage in said concave segment to stop rotation of said indexing wheel.

2. The apparatus of claim 6 wherein said detent means comprises a roller rotatably mounted on the reciprocable member of said second piston and cylinder assembly on an axis parallel to said shaft means.

3. The apparatus of claim 1 further comprising control means operatively associated with each of said piston and cylinder assemblies to cause retraction of the reciprocable member of said second piston and cylinder assembly away from said indexing surface shortly before or substantially simultaneously with the beginning of each stroke of the reciprocable member of said first piston and cylinder assembly in said first directional mode.

4. The apparatus of claim 3 wherein said control means is further operative to initiate extension of the reciprocable member of said second piston and cylinder assembly toward said indexing surface before the end of each stroke of the reciprocable member of said first piston and cylinder assembly in the first directional mode.

5. The apparatus of claim 4 further comprising flow regulation mode for controlling the rate of flow of fluid into and out of the cylinders of said piston and cylinder assemblies and thereby controlling the speed of movement of the reciprocable members, said flow regulation means being operative to cause relatively fast retraction of said reciprocable member of said second piston and cylinder assembly away from said indexing surface and relatively slow extension of the reciprocable member of said second piston and cylinder assembly toward said indexing surface.

6. The apparatus of claim 5 wherein said flow regulation means is further operative to cause relatively slow movement of the reciprocable member of said first piston and cylinder assembly in the first directional mode.

7. The apparatus of claim 6 wherein said flow regulation means is further operative to cause relatively fast movement of the reciprocable member of said first piston and cylinder assembly in the second directional mode.

8. Rotary apparatus comprising:

a stationary assembly;

a rotary assembly mounted on said stationary assembly for rotation relative thereto and including rotary shaft means;

reciprocating drive means;

a driven member connected to said shaft means;

link means drivingly connecting said driven member to said drive means for rotation in a first direction upon reciprocating movement of said drive means in a first directional mode and for rotation in a second direction opposite the first direction upon reciprocating movement of said drive means in a second directional mode opposite said first mode;

clutch means interconnecting said driven member and said shaft means and operative, upon rotation of said drive member in said first direction to cause rotation of said shaft means therewith, and upon rotation of said driven member in said second direction, to permit relative rotation between said driven member and said shaft means, whereby said shaft means is rotated by said drive means in temporally spaced increments and indexing synchronization means operatively associated with said shaft means for positively stopping rotation of said shaft means generally at the end of each movement of said drive means in said first directional mode, said indexing synchronization means comprising an indexing wheel mounted on said shaft means for joint rotation therewith and having a generally radially outwardly facing peripheral indexing surface having at least one convex segment and at least one concave segment, and an indexing piston and cylinder assembly having one member fixed with respect to said stationary assembly and the other member reciprocable with respect to said fixed member generally toward and away from said indexing surface, and detent means carried by the end of said reciprocable member and adapted, when extended toward said indexing surface, to ride along said convex segment to permit rotation of said indexing wheel and engage in said concave segment to stop rotation of said indexing wheel.

9. The apparatus of claim 8 wherein said detent means comprises a roller rotatably mounted on said reciprocable member on an axis parallel to said shaft means.

10. The apparatus of claim 8 wherein said indexing surface includes a purality of generally S-shaped portions each defining one such convex segment and one such concave segment.

* * * * *

UNITED STATES PATENT AND TRADEMARK OFFICE

CERTIFICATE OF CORRECTION

PATENT NO. : 4,354,402

DATED : October 19, 1982

INVENTOR(S) : John W. Scott

It is certified that error appears in the above—identified patent and that said Letters Patent is hereby corrected as shown below:

In Column 14, line 59, delete "6" and insert therefor --1--.

In Column 15, line 12, delete "mode" and insert therefor --means--.

Signed and Sealed this

*Twelfth* Day of *February 1985*

[SEAL]

*Attest:*

DONALD J. QUIGG

*Attesting Officer* *Acting Commissioner of Patents and Trademarks*